US006089987A

United States Patent [19]

Briggs

[11] Patent Number: 6,089,987

[45] **Date of Patent: *Jul. 18, 2000**

[54] RETROFIT WATER PLAY STRUCTURE AND METHOD

[76] Inventor: Rick A. Briggs, 64 Maple Grove, Springfield, Ill. 62707

[ * ] Notice: This patent is subject to a terminal disclaimer.

[21] Appl. No.: 08/972,959

[22] Filed: Nov. 19, 1997

Related U.S. Application Data

[63] Continuation of application No. 08/772,499, Dec. 23, 1996, Pat. No. 5,741,189.

[51] Int. Cl.[7] ..... A63Q 31/00

[52] U.S. Cl. ..... 472/128

[58] Field of Search ..... 472/117, 128, 472/13; 482/35; 285/123.1, 122.1, 123.15, 125.1

[56] References Cited

U.S. PATENT DOCUMENTS

| | | |
|---|---|---|
| D. 277,610 | 2/1985 | Arginsky . |
| D. 330,579 | 10/1992 | Briggs . |
| 1,648,196 | 11/1927 | Rohmer . |
| 3,141,670 | 7/1964 | Smyrni et al. . |
| 3,170,171 | 2/1965 | Mayhew et al. . |
| 3,231,269 | 1/1966 | Dalrymple, Jr. . |
| 3,246,892 | 4/1966 | Grudoski . |
| 3,539,181 | 11/1970 | Larsen . |
| 3,866,916 | 2/1975 | Clarke . |
| 4,145,042 | 3/1979 | Becker et al. . |
| 4,243,220 | 1/1981 | Shelley . |
| 4,548,357 | 10/1985 | Schmidt . |
| 4,786,088 | 11/1988 | Ziu . |
| 4,961,535 | 10/1990 | Skibik . |
| 5,194,048 | 3/1993 | Briggs . |
| 5,378,197 | 1/1995 | Briggs . |
| 5,387,158 | 2/1995 | Bertrand . |
| 5,405,294 | 4/1995 | Briggs . |
| 5,480,336 | 1/1996 | Blanchard . |
| 5,554,074 | 9/1996 | Von Parrish . |
| 5,683,314 | 11/1997 | Musso . |
| 5,741,189 | 4/1998 | Briggs ..... 472/128 |

FOREIGN PATENT DOCUMENTS

| | | |
|---|---|---|
| 1031693 | 3/1956 | Germany . |

OTHER PUBLICATIONS

Mexico Forge Brochure—3800 Series—Model 3813–311.

Gym–Dandy Return of the Jedi brochure—Scout Walker, Command Tower, Swing set with Speeder Bike Ride No. 59340.

Braunfelsbilt Product booklet.

SCS Interactive Family Adventures brochure—Discovery Treehouse.

Various SCS Company brochures—Model 107, 108, 110, 112, 115, 212, 245, 333, 400.

*Primary Examiner*—Kien T. Nguyen

*Attorney, Agent, or Firm*—Knobbe, Martens, Olson & Bear, LLP

[57] ABSTRACT

A low-cost interactive water play structure and method is provided wherein an existing dry play structure is retrofitted or converted to incorporate various interactive water play elements. Water supply conduits are mounted on or in the support members of the dry play structure to provide water to one or more water forming elements and associated control valves. Play participants adjust the various valves and can immediately observe the change in the rate, direction or velocity of water flowing from the various associated water forming elements, allowing play participants to experiment with and learn about various cause-and-effect reactions using a familiar and entertaining play medium.

28 Claims, 9 Drawing Sheets

RETROFIT WATER PLAY STRUCTURE AND METHOD

This application is a continuation of U.S. patent application Ser. No. 08/772,449, filed Dec. 23, 1996, now U.S. Pat. No. 5,741,189.

BACKGROUND OF THE INVENTION

1. Field of the Invention

The present invention relates generally to the field of commercial play structures and, in particular, to "wet" interactive play structures and methods for retrofitting or converting conventional "dry" play structures for interactive water play.

2. Description of the Related Art

The popularity of family-oriented theme parks and commercial recreation facilities has increased dramatically in the last decade. Water parks, in particular, have proliferated as adults and children alike seek the thrill and entertainment of "wet" play attractions as a healthy and enjoyable way to cool off in the hot summer months. Wet play attractions featuring "interactive water play" are especially popular among families having young and intermediate age children.

My U.S. Pat. No. 5,194,048 and related Design Patent D330,579 first disclosed the concept of "interactive water play," in which play participants can operate any one of a number of valves to adjust the amount of water spraying from one or more associated water effects. Play participants adjust the various valves and can immediately observe the change in the rate of water flowing from the various associated water effects. This allows play participants to experiment with and learn about the cause-and-effect relationship between action (pulling a rope or turning a wheel) and reaction (getting doused with a gush of water or watching a water geyser erupt) using a familiar and entertaining medium, namely water. Small children, particularly, can benefit from the fun learning experiences garnered from interactive water play.

Many successful large-scale commercial water parks now incorporate interactive water play structures of the type disclosed in my U.S. Pat. No. 5,194,048. Families that have patronized these commercial water parks have discovered for themselves the valuable entertainment and educational benefits that interactive water play provides. Sales of admission tickets for many such commercial water parks have surged following the introduction of a new interactive water play structure.

Due in part to the increasing popularity of water theme parks, many conventional "dry" (i.e. non-water) recreation parks have sought to add various wet play attractions to meet growing demand for such attractions and to increase overall park attendance. However the cost of many large-scale water attractions, in terms of initial capital expenditures and operation and maintenance costs, is often prohibitive. Many dry recreation parks do not have existing systems for drainage and/or recirculation of the large quantities of run-off water often generated by such large-scale water attractions. Moreover the level of patronage and revenues generated by many conventional dry recreation parks, particularly in rural or suburban areas, would not justify the expense of installing extensive water drainage and recirculation systems.

SUMMARY OF THE INVENTION

There is an unfulfilled need in the industry for a low-cost interactive water play structure that is particularly adapted for use in conventional dry recreation parks and that does not necessarily require the use of extensive water drainage or recirculation systems. There is a further need in the industry for an interactive water play structure that can be fabricated by retrofitting or converting a conventional dry play structure for interactive water play. There is a further need in the industry for a low-cost interactive water play structure that allows play participants to change or alter the water effects by the simple physical acts of pushing a lever, pulling a rope, hitting a button or turning a valve, thereby enhancing their knowledge of water dynamics, shapes, forms, textures, and various dynamic water effects. Finally, there is a need in the industry for a play structure that synergistically combines both wet and dry play elements to create a single integrated play unit such that the synergistic interplay of wet and dry play elements results in a whole that is more exciting, creative, and fun than the sum of its parts.

In accordance with one embodiment, the present invention provides a method of retrofitting or converting an existing dry play apparatus to incorporate various interactive wet play elements. This is accomplished by inserting water supply tubing inside the hollow support members of an existing dry play apparatus and using this tubing to transport water from a water supply source to water forming devices and associate control valves disposed throughout the play apparatus.

In accordance with another embodiment, the present invention provides a method of retrofitting or converting an existing dry play apparatus to incorporate various wet play elements. This is accomplished by disposing water supply tubing along the exterior surface of the non-hollow support members of the apparatus and using this tubing to transport water from a water supply source to water forming devices disposed throughout the dry play apparatus.

In accordance with another embodiment the present invention provides a water play structure having a plurality of support members, with hollow tubes or conduits inserted in or disposed adjacent to the support members, said hollow tubes carrying water from a water supply source to water forming devices located throughout the retrofit play structure.

Advantageously, the present invention not only makes possible the fabrication of inexpensive interactive water play structures, but it also allows retrofitting of existing dry play structures for interactive water play. By retrofitting or converting an existing dry play structure for interactive water play in accordance with the present invention, the normal expenses associated with the design, development and installation of a new interactive water play structure are greatly reduced. A related benefit is that existing manufacturers of dry play structures can incorporate a variety of wet play elements into currently produced dry play structures, allowing these manufacturers to offer both wet and dry versions of existing product lines without requiring substantial changes in manufacturing techniques or retooling of production lines. Moreover, because the inner surfaces of the support members do not contain the pressurized water transported by the conduits, they need not be coated or galvanized against corrosion, resulting in even further cost savings. The resulting manufacturing efficiency and flexibility in accordance with the present invention provides an enhanced product offering at significant cost savings.

Another feature and advantage of the subject invention is the synergistic integration of play elements and support structure. The method and manner in which components are arranged in the play environment significantly effects the educative process and degree of enjoyment that play participants experience. Often, dry play structures consist of isolated passive play elements separated by empty spaces. The subject invention not only provides interactive play elements, but allows the use of empty spaces by yet other play participants, and coordinates many, if not all, play elements, valves, and water-forming devices into one integrated unit such that the synergistic interplay results in a whole that is more exciting, creative, and fun than the sum of its parts. Participants can experience and learn the value of interactive and cooperative play in a fun and enjoyable environment.

These and other embodiments, features and advantages of the present invention will become readily apparent to those skilled in the art from the following detailed description of the preferred embodiments having reference to the attached drawings, the invention not being limited to any particular preferred embodiment disclosed or described herein.

DETAILED DESCRIPTION OF THE PREFERRED EMBODIMENTS

Basic Dry Play Structure

Figure 1:
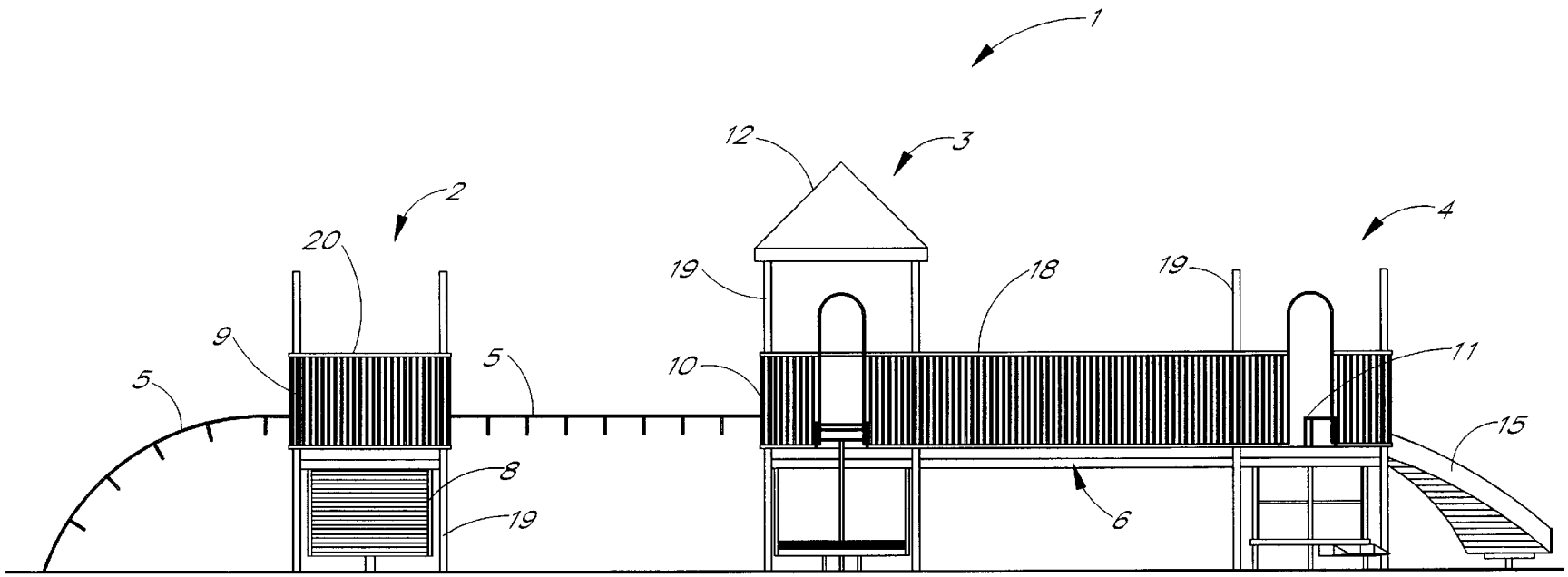
FIG. 1 is a front elevation view of a dry play structure prior to retrofitting in accordance with the present invention.
Figure 2:
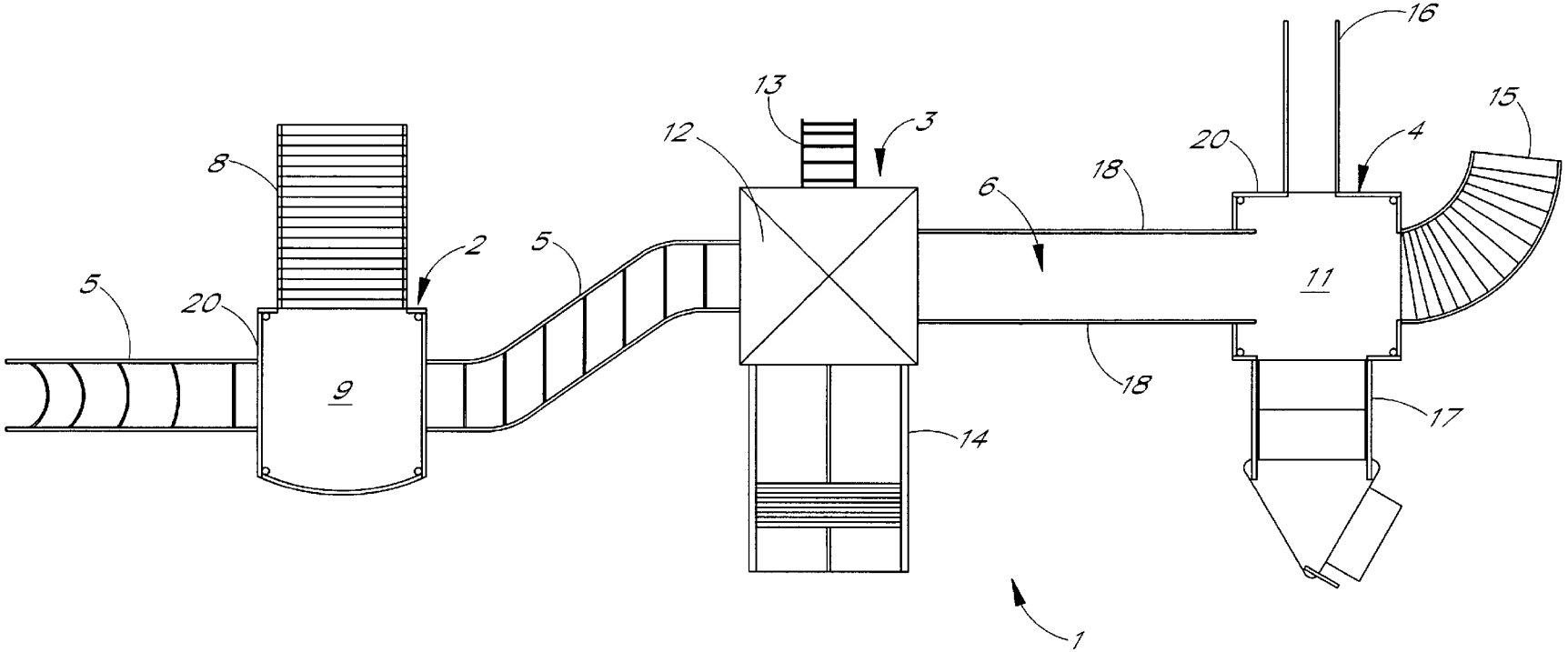
FIG. 2 is a top plan view of the dry play structure of FIG. 1.

FIGS. 1 and 2 are front elevation and top plan views, respectively, of a basic dry play structure prior to retrofitting in accordance with the present invention. The particular play structure shown is of an open frame design provided in the theme of a fortress or wilderness outpost or the like. Of course, those skilled in the art will readily appreciate that the present invention may be used with a wide variety of other possible dry play structures and exciting play themes or they may be unthemed. For example, a medieval castle, lost temple, military fort or fire station can each provide an exciting play theme for a play structure having features and advantages as taught herein. Other framing designs can also be used such as enclosed structures, molded fiberglass structures and the like.

The play structure 1 basically comprises a multi-level structure fabricated using any number of convenient materials and construction techniques well known to those skilled in the art. The structure 1 may be suitable for either outdoor or indoor use, as desired. Preferably, the structure 1 comprises a supporting framework formed from a plurality of interconnected support members, such as posts 19 and beams or rails 20. The support members 19, 20 may be formed from any number of convenient materials having sufficient strength and durability to safely support multiple play participants. For example, hollow plastic or PVC pipes, aluminum or steel pipes, I-beams or channel beams, reinforced concrete posts or beams, and the like may all be used to form the supporting framework for the play structure 1. Preferably, posts 19 and beams 20 are hollow aluminum posts and beams having diameters ranging from about 4 to 6 inches. The posts 19 and beams 20 may be round or square in cross-section, as desired, or they may be provided in other cross-sectional shapes. Of course, those skilled in the art will appreciate that the present invention may be used with play structures constructed of other materials, such as solid metal beams, wood timbers, and/or other hollow or non-hollow support members.

A number of platforms 9, 10 and 11 are preferably supported between adjacent post members 19 at various desired elevations with respect to ground level, defining play areas 2, 3 and 4. Play area 3 has an optional peaked roof 12, as shown. As best illustrated in FIG. 2, the platforms are preferably of similar shape and dimension such they can be assembled in a modular fashion, as shown. Mating 4'×4' square platforms and 4'×8' rectangular platforms are preferred, although it is envisioned that any one of a number of other suitable modular or non-modular shapes and sizes may also be used, including without limitation, triangles, pentagons, hexagons and/or trapezoids. Various dry play elements 5, 6, 8 and 13–17 are disposed in, on or around the play areas 2, 3 and 4, and may be accessed from the associated platforms 9, 10 or 11.

The various dry play elements are best illustrated in FIG. 2, which is a top plan view of the dry play structure of FIG. 1. Play area 2 is connected between ground level and to play area 3 by "monkey bars" 5. Other dry play elements incorporated in play area 2 include a wide slide or ramp 8 which is accessible from either ground level or the raised platform 9. Play area 3 is connected to play area 4 by elevated bridge 6 and railings 18. Other dry play elements incorporated in play area 3 include a ladder 13 and a double slide 14. Play area 4 also includes several dry play elements such as a curved slide or ramp 15 accessible from either ground level or the raised platform 11, a slide 16 and access steps 17.

Retrofit Water Play Structure

Figure 3:
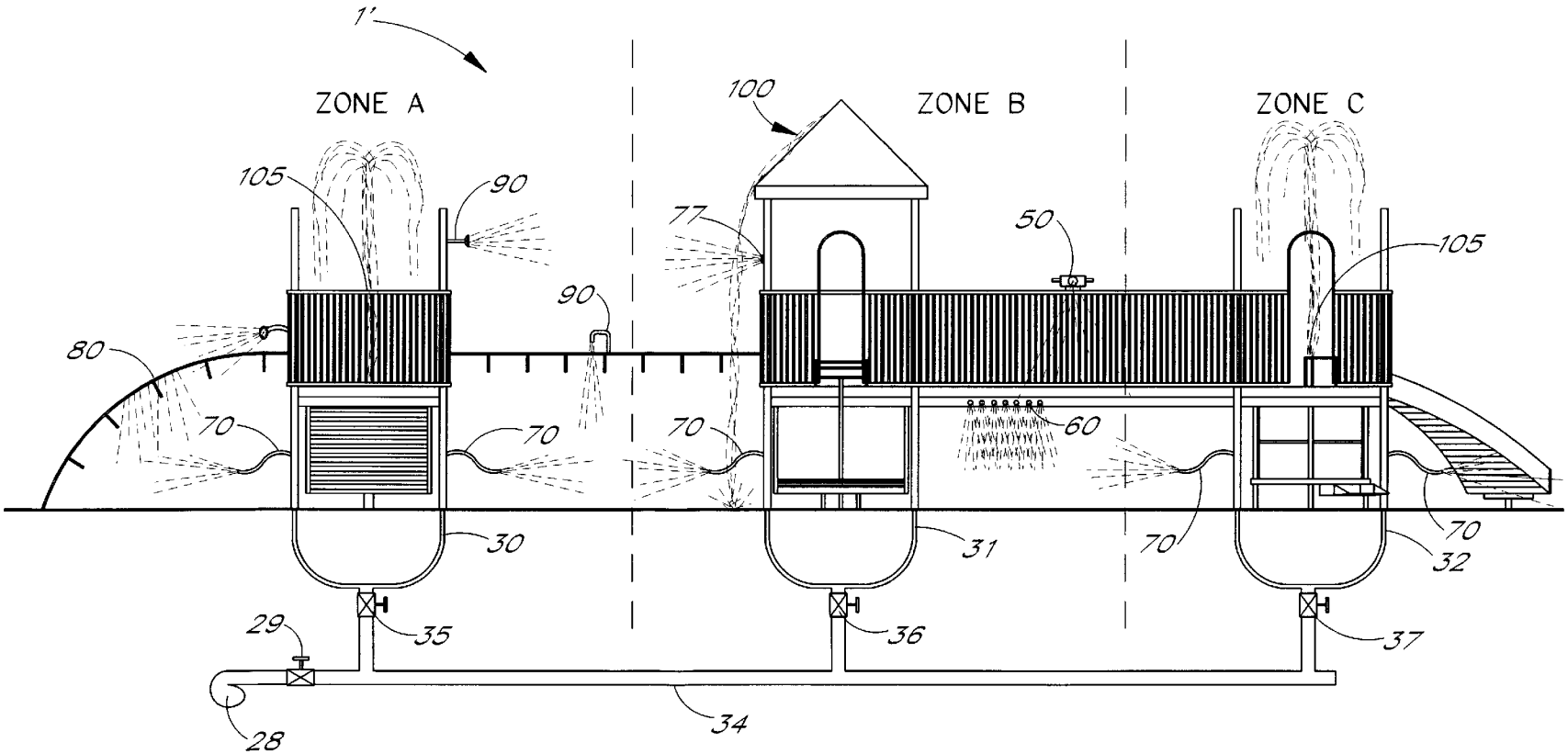
FIG. 3 is a schematic front elevation view of a wet interactive water play structure having features of the present invention and being formed by retrofitting or converting the dry play structure of FIG. 1.
Figure 4:
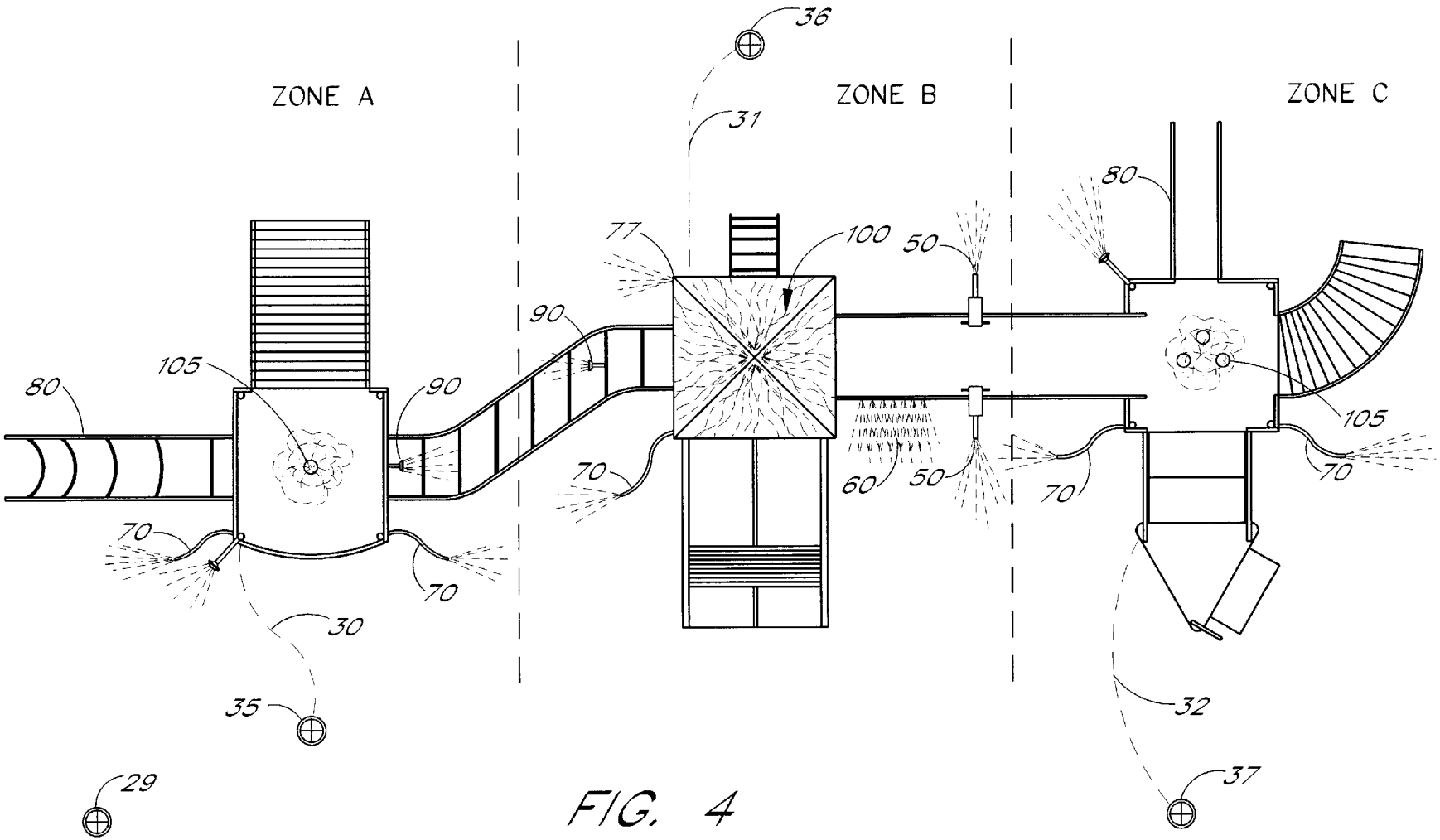
FIG. 4 is a schematic top plan view of the wet interactive water play structure of FIG. 3.

FIGS. 3 and 4 are schematic front elevation and top plan views, respectively, illustrating the play structure of FIGS. 1 and 2 after retrofitting for interactive water play in accordance with the present invention. In addition to the dry play elements, described above, the retrofit water play structure 1' incorporates a number of interactive water play elements, such as waterguns 50, bar jets 60, hose jets 70, mist jets 77, horizontal jets 80, overhead rope-pull jets 90, water falls 100 and jet geysers 105. These elements are described in more detail later.

As can be seen from FIGS. 3 and 4, the play structure 1' has been divided into three zones, A, B and C, each of which has an associated water distribution main 30, 31 and 32, respectively. In operation, a pump 28 or other supply source provides water through master control valve 29 to supply main 34 and then to each of the distribution mains 30, 31 and 32. Isolation valves 35, 36 and 37 regulate water flow through each of the distribution mains 30, 31 and 32, respectively, in order to provide a safe, balanced and functional rate of water flow to the various control valves and water forming devices in each zone A, B and C. Isolation valves 35, 36 and 37 also permit zone sequestering in order to facilitate independent temporary or emergency shutdown of a defective or malfunctioning zone while permitting operation of unaffected zones.

Preferably, the water supply main 34 and distribution mains 30, 31, and 32 are buried in the ground adjacent the play structure 1' so as to provide a subterranean water supply and distribution system. Master control valve 29 and isolation valves 35, 36 and 37 are preferably mounted above-ground and/or in one or more accessible wells in order to facilitate adjustment thereof. While subterranean water distribution is preferred, alternative embodiments may include ground-level or elevated above-ground water supply and/or distribution systems, as may be convenient or desirable for the functioning of the play structure and/or to complement a desired theme.

Drainage may be provided, if desired, as either a waste water system or a recirculation system. If waste water drainage is provided, then preferably the various interactive water forming devices 50, 60, 70, 77, 80, 90, 100, 105 are selected and/or adjusted to provide relatively low water output (less than about 200 gallons per minute (gpm) so as to reduce overall waste water runoff. If water recirculation is provided, then the overall water output of the interactive water play elements is less critical, although it may still be desirable to conserve water usage in order to minimize the energy required to run the water recirculation pump(s).

For example, in the particular preferred embodiment shown in FIGS. 3 and 4, zone A produces a maximum or peak flow rate of approximately 26 gpm, zone B produces a peak flow rate of approximately 42 gpm, and zone C produces a peak flow rate of approximately 32 gpm for a total peak output of about 100 gpm. The flow capacity of recirculation pump 29 is preferably selected or adjusted to approximately match the overall peak output of the water play structure 1'. Alternatively, water requirements for each zone may be supplied by one or more individual recirculation pumps or other sources, as desired.

Illustrative water flow requirements for each of the various individual water play elements are summarized in TABLE 1 below:

TABLE 1

| Ref. No. | Description | gpm (per effect) |
|---|---|---|
| 50 | waterguns | ≈2 gpm |
| 60 | bar jets | ≈5–10 gpm |
| 70 | hose jets | ≈15 gpm |
| 77 | mist jets | ≈2 gpm |
| 80 | horizontal jets | ≈5–10 gpm |
| 90 | overhead rope-pull jets | ≈2–5 gpm |
| 100 | water falls | ≈15–25 gpm |
| 105 | jet geysers | ≈5–10 gpm |

Figure 5:
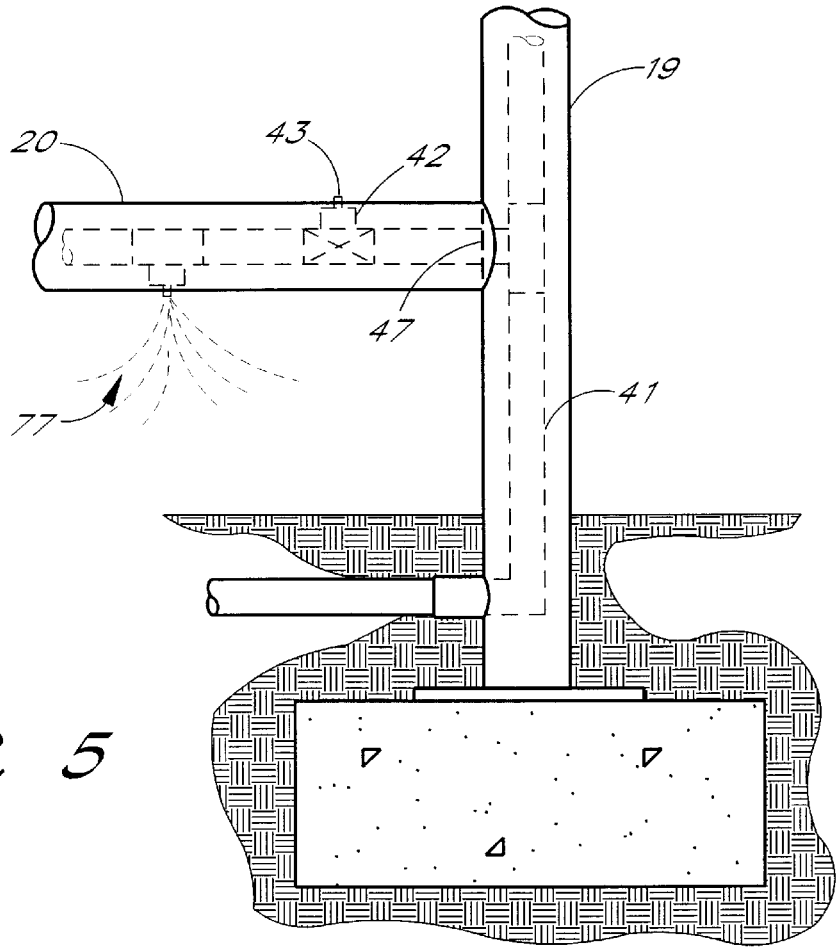
FIG. 5 is a schematic view illustrating one possible method for retrofitting hollow support members of a dry play structure for interactive water play in accordance with the present invention.
Figure 6:
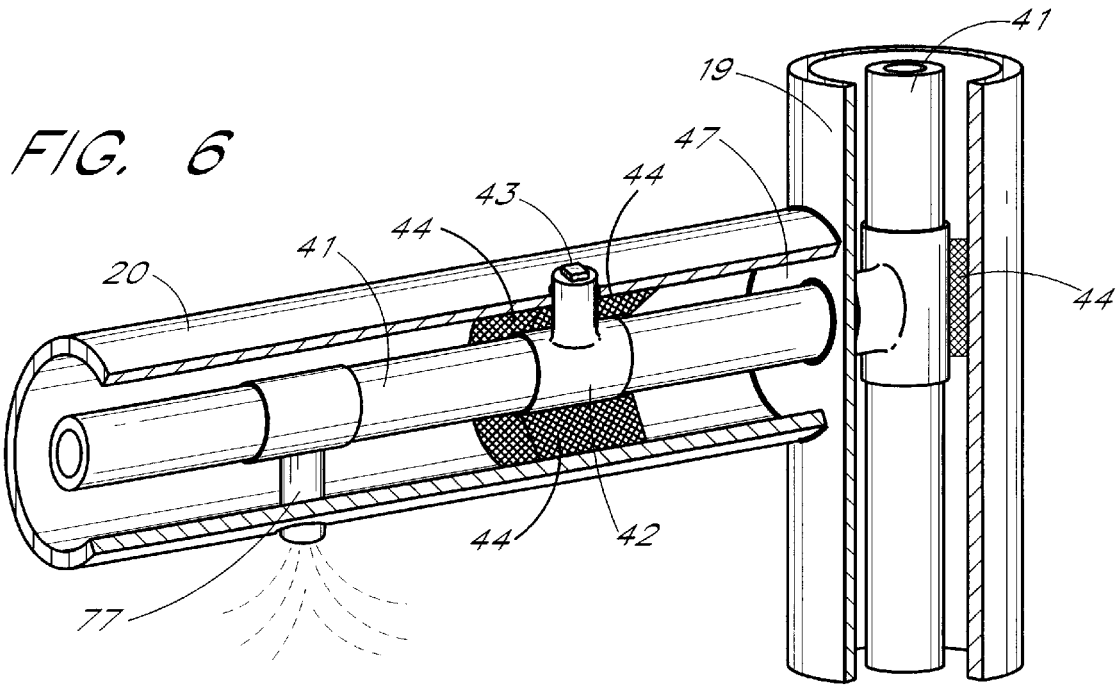
FIG. 6 is a detail cross-section view of the support members of FIG. 5 retrofitted in accordance with the present invention.

FIGS. 5 and 6 are schematic and partial cross-sectional views, respectively, of one section of a typical retrofit water play structure having features of the present invention. FIG. 5 illustrates one preferred method for retrofitting or converting hollow support members of a dry play structure to accommodate interactive water play elements. In accordance with one preferred embodiment, water supply tubing or conduit 41 having an external diameter less than the internal diameter of support members 19 and 20 is positioned within the hollow support members 19 and 20, as shown. Holes are drilled in the intersecting wall portions 47 of hollow support members 19 and 20, as needed, to accommodate insertion and passage of the supply conduit 41 throughout the play structure.

Control valve 42 is mounted within the hollow support member 20, as shown, with the actuator extending through an opening provided in the outer wall of the support member. The valve 42 may comprise any number of commercially available valves well known to those skilled in the art. These may include, for example, wheel-controlled butterfly valves, lever-controlled butterfly valves, counter-weight valves, gate valves, flush valves, wheel-controlled ball valves, lever-controlled ball valves, and any number of other control valves well know to those skilled in the art. A standard 1 inch diameter in-line ball valve should be suitable for most purposes. Push-button actuated valves are particularly preferred. These can be instantaneous on/off valves, sustained on/off valves, variable flow valves, or other types of push-button valves, as desired. Electric solenoid valves and the like may also be used, provided that the circuitry is well isolated and/or the operating voltage is sufficiently low to avoid a shock hazard.

Those skilled in the art will appreciate that valve 42 operates mist jet 77, which is also mounted within the hollow support beam member 20, as shown in FIG. 6. The mist jet 77 comprises a nozzle having an opening formed at the discharge end thereof and adapted to spray a mist or fan pattern of water into the air, as shown. The nozzle portion of the mist jet 77 is aligned with an opening formed in the outer wall of the hollow support beam member 20, as shown, to allow spraying of water when push button 43 of valve 42 is actuated. A threaded collar (not shown) may be used to secure the nozzle portion of mist jet 77 to the wall of the hollow support beam member 20. Optionally, the mist jet 77 or a portion thereof may be adapted to rotate to allow play participants to adjust the spray pattern from a fine mist to a coarse stream in accordance with well known principles of spray nozzle design.

In order to keep internal conduit 41 and various other components of the interactive water play elements, such as push-button actuated control valve 42 and mist jet 77, in a fixed position relative to the support members 19 and 20, optional internal packing or bracing 44 may be used inside the hollow support members 19 and 20, as desired. Bracing materials may include, without limitation, silicone, rubber, styrofoam, or the like. Alternatively, these and/or other components can be secured to the hollow support members by a threaded lock ring or the like (not shown), threaded over a protruding end of a nozzle or push button actuator. Optionally, if desired, openings formed in the wall of the support members 19 and 20 may be countersunk to accommodate a threaded lock ring or the like.

Internal conduit 41 may comprise any one of a number of water-carrying pipe or tube structures well know to those skilled in the art. Polyvinyl chloride (PVC) pipes are particularly preferred because of their light weight, durability and low cost. Of course, other durable materials such as plastic, fiberglass, ceramic, copper or galvanized steel may also be used to form conduit 41 as the particular application permits. If desired, one or more portions of the conduit 41 or all of the conduit 41 may comprise flexible hosing, such as rubber or polytetrafluoride (PTF).

Internal conduit 41 is preferably round and has an outer diameter of between about ¼ and 3 inches and, more preferably, between about ¾ and 1½ inches, and most preferably, about 1 inch. This should ensure adequate volume of water flow and water pressure throughout the play structure. Alternatively, a wide variety of other types and sizes of conduit may be used while still enjoying the benefits of the invention herein disclosed. Individual conduit sections may be connected to one another using any one of a number of well-known pipe-joining devices or techniques available to those skilled in the art, including without limitation threaded assembly, press-fit, gluing, heat welding, ultra-sonic welding, chemical welding or bonding, as desired. Threaded assembly and/or chemical welding is preferred, however, for durability and ease of assembly.

Water supply conduit 41 can either be of a uniform diameter and/or water carrying capacity throughout the play structure 1' or, if desired, certain portions may be of a larger or smaller internal diameter than other portions in order to balance the flow of water and pressure to the various interactive water play elements. Alternatively, one or more flow restrictors or orifices (not shown) may be provided in the flow path of water through one or more portions of the conduit 41 in order to help balance the flow of water to the various water play elements in accordance with well known principles of hydrodynamics.

In alternative embodiments, the subject invention may also be utilized in connection with play structures that incorporate solid or semi-solid support members. In that case, water supply conduit 41 may be secured to an external surface of the support structure, rather than inside the support members. Those skilled in the art will recognize that a wide variety of interactive water play elements can be incorporated in various types of dry play structures in accordance with the general principles and teachings of the present invention as taught herein.

The present invention makes possible the fabrication of inexpensive interactive water play structures and also allows retrofitting of existing dry play structures for interactive water play. Thus, the normal expenses associated with the design, development and installation of a new interactive water play structure are greatly reduced. By incorporating a variety of wet play elements into currently produced dry play structures, existing manufacturers of dry play structures can offer both wet and dry versions of existing product lines without substantial changes in their manufacturing techniques or retooling of production lines. As the water supply for the wet play structure is not contained by the inner surfaces of the support members, such surfaces need not be coated or galvanized against corrosion, resulting in even further cost savings. The resulting manufacturing efficiency and flexibility in accordance with the present invention provides an enhanced product offering at significant cost savings.

The subject invention also advantageously allows the utilization of empty spaces in a dry play structure by yet other play participants, and coordinates many, if not all, play elements, valves, and water-forming devices into one integrated unit such that the synergistic interplay results in a whole that is more exciting, creative, and fun than the sum of its parts. The method and manner in which components are arranged in the play environment significantly effects the educative process and degree of enjoyment that play participants experience. Thus, play participants can experience and learn the value of interactive and cooperative group play in a fun and enjoyable environment.

Interactive Water Play Elements

Figure 7:
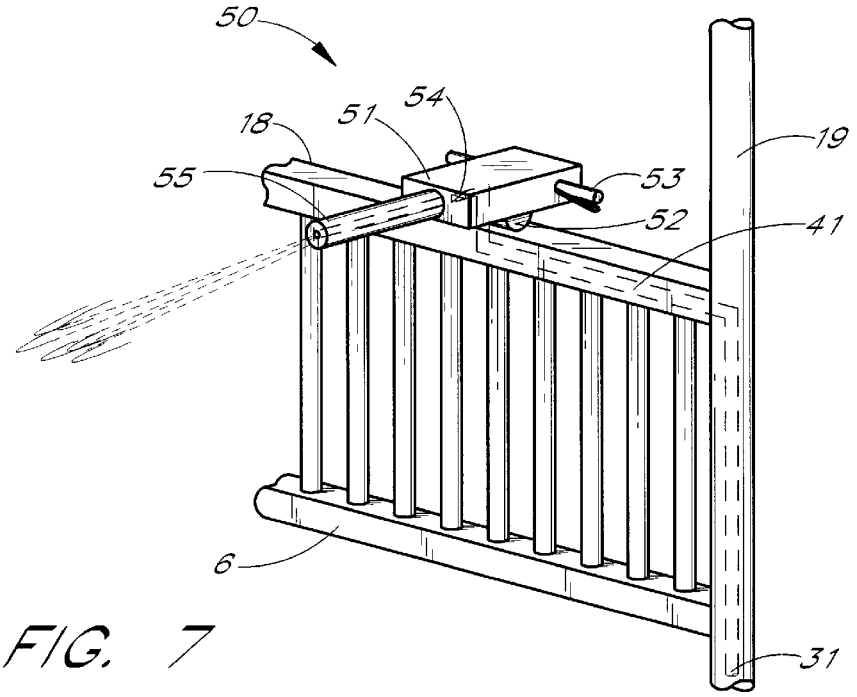
FIG. 7 is a partial schematic view of an interactive water play element provided in the form of a play-participant-actuated watergun.

FIG. 7 illustrates one embodiment of an interactive water play element provided in the form of a watergun 50 mounted on a railing 18. Watergun 50 generally comprises a housing 51 mounted on a swivel base 52, and a nozzle 55 from which water is ejected. In operation, a play participant depresses a handle or trigger 53 causing a valve 54 (shown here schematically) to open. Water from supply conduit 41 passes through valve 54 and is ejected out nozzle 55 as a continuous or broken stream of water. When the handle 53 is released, the watergun valve 54 preferably automatically returns to a closed position, stopping the flow of water through the nozzle 55. The water supply for watergun 50 is provided by supply conduit 41 which runs from distribution main 31 to watergun 50 within the hollow interior of support member 19, as described above. Supply conduit 41 is preferably about ¼ to ½ inch in diameter, depending upon water flow requirements.

Figure 8:
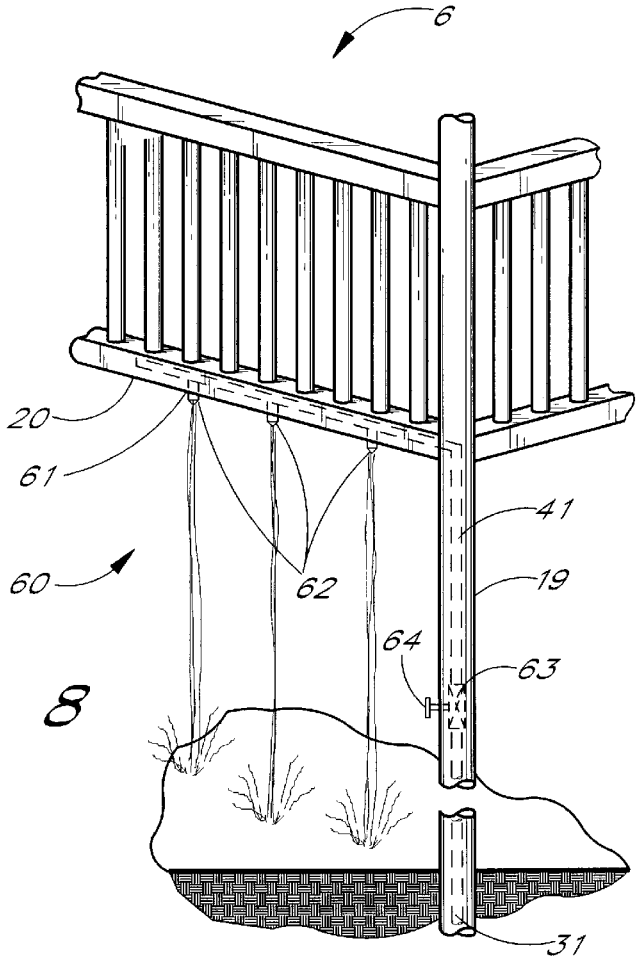
FIG. 8 is a partial schematic view of an interactive water play element provided in the form of a play-participant-actuated overhead bar jet.

FIG. 8 illustrates one embodiment of an interactive water play element provided in the form of one or more bar jets 60 provided on the underside of a horizontal support beam 20 such as on elevated bridge 6. Bar jets 60 preferably comprise one or more openings 61 provided on the underside of horizontal support beam 20. Downward directed nipple nozzles 62 are disposed in the openings 61 and, when actuated, eject downward vertical streams of water simulating, for instance, the bars of a prison cell or a laser beam force field. Water supply for bar jets 60 is provided by supply conduit 41 which runs from distribution main 31 to each of the nipple nozzles 62 through the hollow interior of post member 19 and horizontal support beam 20 of elevated bridge 6. Alternatively, conduit 41 may have formed therein a series of longitudinally spaced apertures for spraying streams of water and the horizontal support beam 20 may have a corresponding slotted opening (not shown) for accommodating the spraying water.

A push-button actuated control valve 63 is provided in the path of water flow through the conduit 41 such that it controls the water supplied to the bar jets 60. Water will shoot out of bar jets 60, for example, when a play participant depresses push-button 64. Persons skilled in the art will appreciate that the push-button 64 may either be placed inside of the water spray pattern from bar jets 60 or outside the water spray pattern, depending upon the effect desired.

Figure 9:
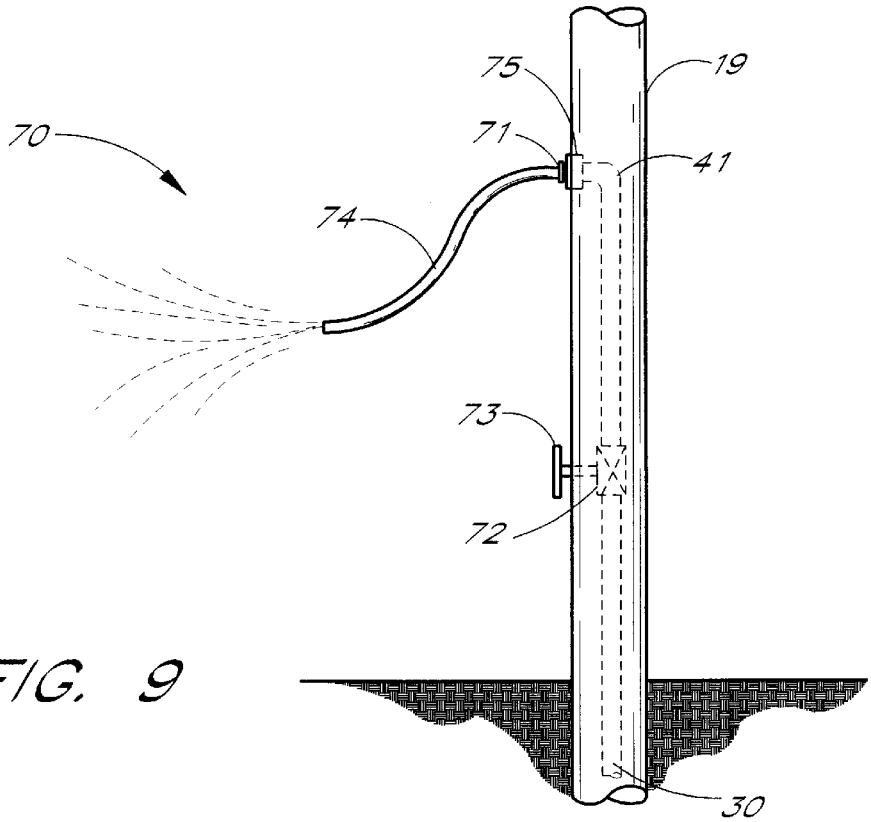
FIG. 9 is a partial schematic view of an interactive water play element provided in the form of a play-participant-actuated hose jet.
Figure 10:
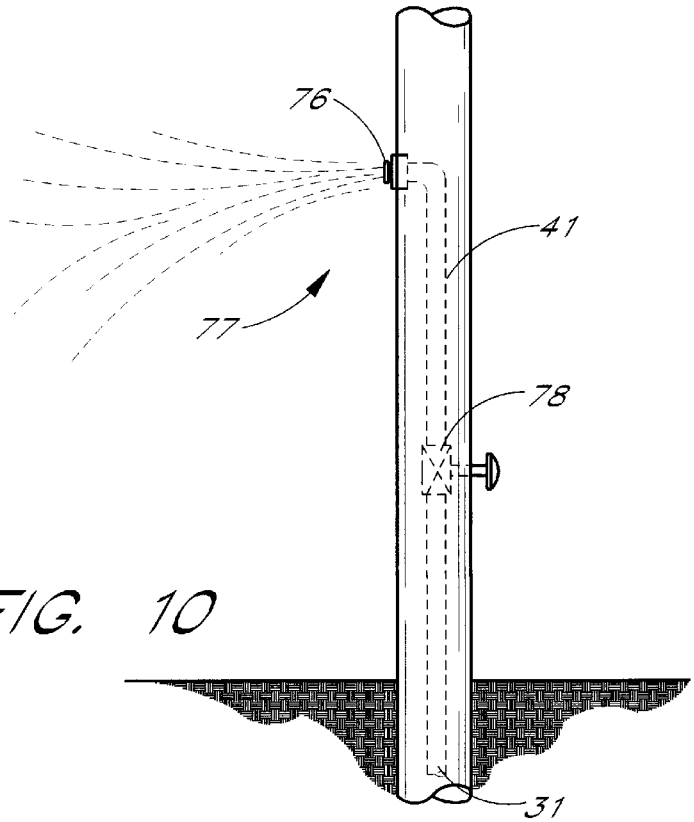
FIG. 10 is a partial schematic view of an interactive water play element provided in the form of a play-participant-actuated stream or mist jet.
Figure 11:
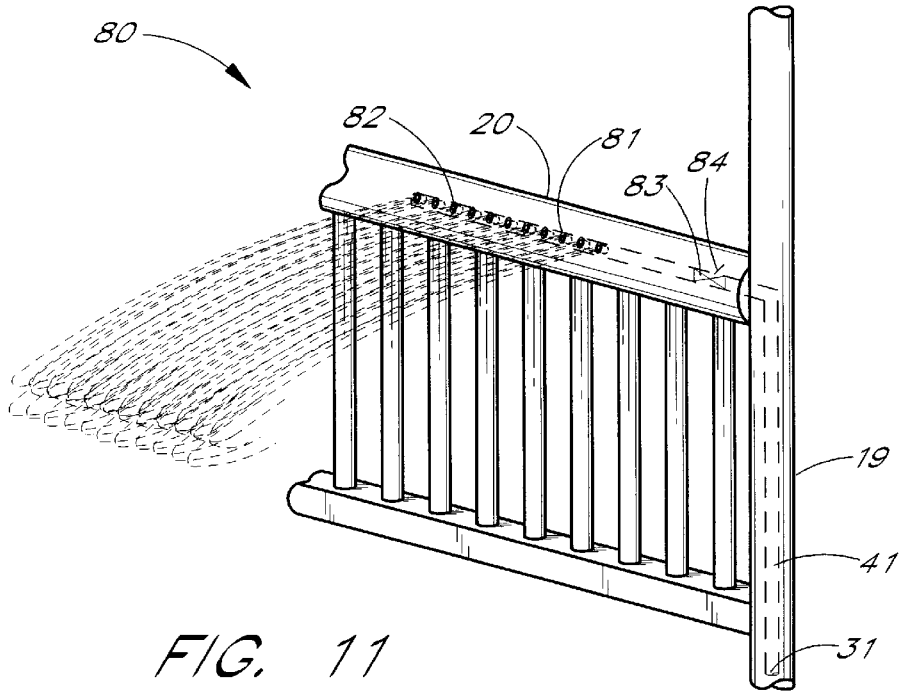
FIG. 11 is a partial schematic view of an interactive water play element provided in the form of a play-participant-actuated horizontal stream jet.

FIG. 9 shows one embodiment of an interactive water play element provided in the form of a hose jet 70. Hose jet 70 preferably comprises a suitable hose fitting or nozzle 71 mounted on the hollow post member 19. The water supply for hose jet 70 is provided by supply conduit 41 from distribution main 30 through the hollow interior of support member 19, as described above. A control valve 72, preferably push-button actuated, is provided in the path of water flow through the supply conduit 41 such that it controls water to the hose jet. In operation, a play participant will depress push button 73, which will in turn open control valve 72, allowing water to flow out of nozzle 71. A ½ to ¾ inch heavy duty rubber hose 74 is attached to hose fitting 75 to allow a water play participant to direct the flow of water emitting from the hose jet 70. Alternatively, the valve 72 may be a standard in-line ball valve and the hose 74 may include a play-particises through valve 83 to horizontal jets 80 when push button 84 or other suitable actuator is depressed.

Figure 12:
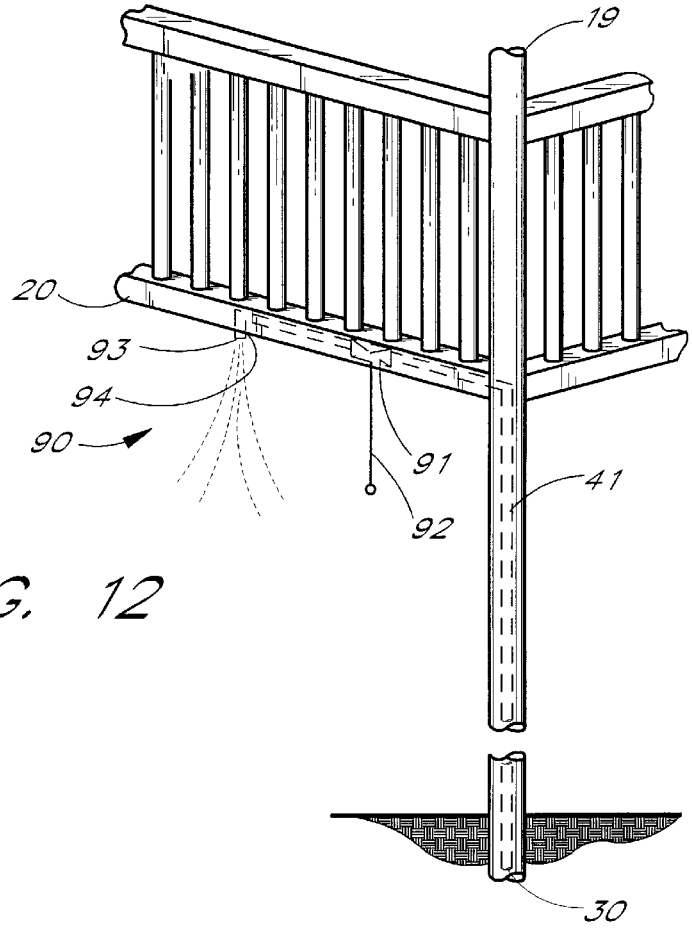
FIG. 12 is a partial schematic view of an interactive water play element provided in the form of an overhead rope-pull-actuated mist jet.

FIG. 12 illustrates one embodiment of an interactive water play element provided in the form of an overhead rope-pull jet 90 mounted on a horizontal support beam 20. Rope-pull jet 90 preferably comprises a pull-rope-actuated valve 91 (shown schematically), a pull-rope 92 and one or more overhead spray jets 93 provided in corresponding openings 94 formed in horizontal support beam 20. Water supply for rope-pull jet 90 is provided by supply conduit 41 running from distribution main 30 to rope pull jet 90 through the hollow interiors of support member 19 and horizontal support beam 20. Valve 91 is provided in the path of water flow through conduit 41 such that water may pass through valve 91 when rope 92 is tugged on by a play participant. The water then sprays out of the spray jet 93 onto play participants below. When rope 92 is released, valve 91 preferably returns to its closed position and water ceases to shoot out of spray jet 93.

Figure 13:
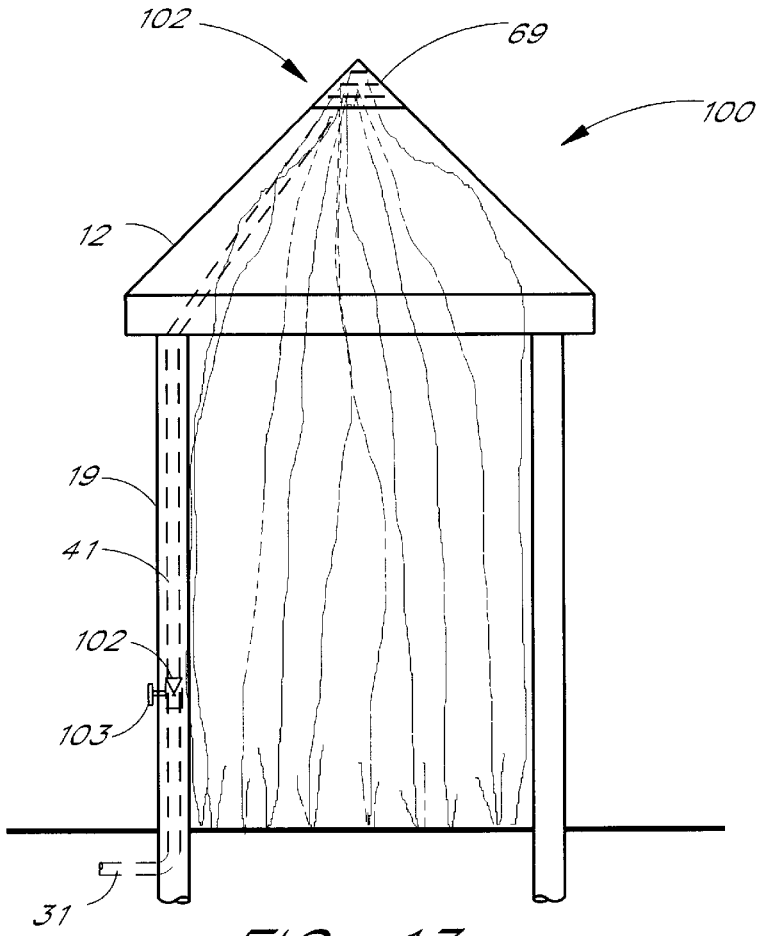
FIG. 13 is a partial schematic view of an interactive water play element provided in the form of a play-participant-actuated water falls.

FIG. 13 illustrates one embodiment of an interactive water play element provided in the form of a water falls 100. Preferably, water falls 100 comprises a water distribution box 101 mounted on the top of peaked roof 12, as shown, or other elevated structure. One or more slotted openings or weirs or openings are provided along various sides of the water distribution box 101 through or over which water is allowed to flow. Water supply for water falls 100 is provided by supply conduit 41 running from distribution main 31 to water distribution box 101 through the hollow interior of support member 19 and along the underside of peaked roof 12. Valve 102, preferably push-button actuated, is provided in the path of water flow through conduit 41 such that water may pass through valve 102 to distribution box 101 when push button 103 is depressed by a play participant. The water then continuously showers down one or more sides of the roof 12 simulating a water curtain or water fall. Alternatively, water distribution box 101 may be mounted under, or partially through peaked roof 12, such that water flowing from water distribution box 101 will flow both on and under peaked roof 12, thereby enhancing the water play effect and allowing more play participants to get wet.

Figure 14:
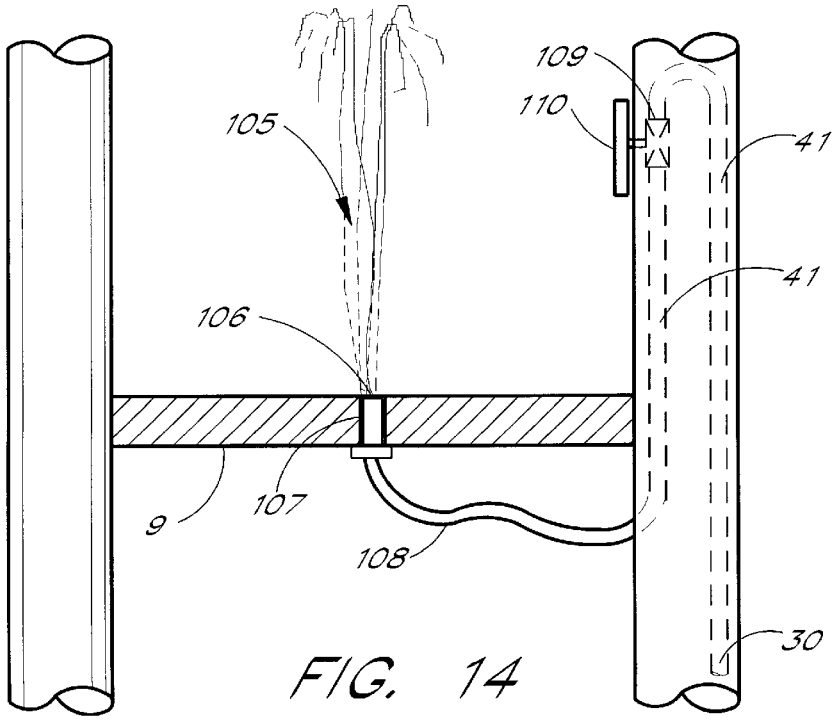
FIG. 14 is a partial schematic view of an interactive water play element provided in the form of a play-participant-actuated jet geyser.

FIG. 14 illustrates one embodiment of an interactive water play element provided in the form of a jet geyser 105, mounted in raised platform 9. Jet geyser 105 preferably comprises an upward directed nozzle 106 mounted in an opening 107 formed in raised platform 9. The nozzle 106 may comprise ½ to ¾ inch PVC pipe flush-mounted with the top surface of platform 9. Water supply hose 108, comprising ½ to ¾ inch flexible hose, PVC pipe or the like, extends underneath the platform 9 and is connected between nozzle 106 and supply conduit 41. Control valve 109, preferably push-button actuated, is provided in the path of water flow from the distribution main 30 to the nozzle 106. When the control valve 109 is actuated, water shoots upwards from nozzle 106, simulating an erupting geyser. Preferably, when the play participant releases button 110, control valve 109 automatically closes and stops water flowing to the nozzle 106. If desired, a plurality of jet geysers may be mounted in the floor of a platform, as shown in raised platform 11 of FIG. 4. Alternatively, the geyser jet 105 could be of the jumping-water-ball type wherein balls or short sports of water are caused to jump upward out of the nozzle when the control valve 109 is actuated.

It should be noted that, in alternate embodiments of the subject invention, other types of valves and activation devices may be used in the place of the push button control valves described in the above invention. Such activation devices may include handwheels, levers, gate valves and the like. In addition, a plurality of valves and activation devices may be used such that participants must operate two or more valves or activation devices simultaneously in order to achieve the desired water effect, thus fostering group interactive participation.

Although this invention has been disclosed and described in the context of certain preferred embodiments, it will be understood by those skilled in the art that the present invention extends beyond the specific disclosed embodiments to other alternative embodiments of the invention. Thus, it is intended that the scope of the present invention herein disclosed should not be limited to the particular disclosed embodiments described above, but should be determined only by a fair reading of the claims that follow.

What is claimed is:

1. A water play apparatus, comprising:

a support structure including a plurality of play modules and hollow support members for safely supporting one or more play participants playing in, on or around said support structure and means interconnecting said play modules;

one or more water supply tubes disposed inside one or more of said hollow support members, said supply tubes having an external diameter that is less than the internal diameter of said hollow support members for preventing water from contacting and/or corroding the inner surface of said hollow support members;

one or more water play elements located on or around said support structure and in fluid communication with said water supply tubes for spraying water and/or creating various desired water play effects, said one or more water play elements being selected and/or adjusted to provide an aggregate water flow of less than about 200 gallons per minute; and one or more push-button actuated water control devices disposed and arranged on or adjacent said support structure and accessible to play participants playing in, on or around said support structure so as to allow play participants to actively and selectively control water flow through said hollow tubes to one or more of said interactive water play elements by depressing an associated gush button, each of said push-button actuated water control devices being further adapted to automatically shut off water flow to said interactive water play elements after said associated push-button is released so as to reduce wastage of water when water recirculation is not provided;

whereby play participants can actively adjust said one or more water control devices and observe the change in the rate or direction of water spraying from said one or more associated water play elements.

2. The water play apparatus of claim 1, wherein at least one of said plurality of hollow support members comprises a load-bearing support member.

3. The water play apparatus of claim 1, wherein said water supply tubes comprise substantially non-load-bearing members.

4. The water play apparatus of claim 1, wherein at least one of said water play elements comprises a watergun.

5. The water play apparatus of claim 1, wherein at least one of said water play elements comprises bar jets.

6. The water play apparatus of claim 1, wherein at least one of said water play elements comprises hose jets.

7. The water play apparatus of claim 1, wherein at least one of said water play elements comprises horizontal water jets.

8. The water play apparatus of claim 1, wherein at least one of said water play elements comprises an overhead rope-pull jet.

9. The water play apparatus of claim 1, wherein at least one of said water play elements comprises a water fall.

10. The water play apparatus of claim 1, wherein at least one of said water play elements comprises a jet geyser.

11. The water play apparatus of claim 1, wherein at least one of said water play elements comprises a mist jet.

12. The water play apparatus of claim 1, wherein at least one of said water control devices comprises a valve portion and an actuator portion and wherein the valve portion is mounted within one of said hollow support members and wherein the actuator extends through an opening provided in the outer wall of the hollow support member.

13. The water play apparatus of claim 1, wherein at least one of said water control devices comprises a variable flow valve.

14. The water play apparatus of claim 1, further comprising one or more isolation valves for substantially hydraulically isolating a first group of water play elements and associated water control devices from a second group of water play elements and associated water control devices.

15. A water play structure, comprising:

a multi-level load-bearing support structure, including multiple interconnected play areas, for safely supporting one or more play participants playing in, on or around said support structure, said support structure comprising at least one load-bearing support member comprising a hollow post;

one or more water forming devices disposed in, on or around said support structure for spraying water and/or creating desired water effects, said one or more water forming devices being selected and/or adjusted to provide an aggregate water flow of less than about 200 gallons per minute;

one or more non-load-bearing hollow conduits disposed inside said post for preventing water from contacting the inside of said post and for supplying water from a first elevation to said one or more water forming devices at a second elevation higher than said first elevation; and one or more play-participant-operated control devices disposed on or adjacent said support structure, said play-participant-operated control devices adapted and arranged to be accessible and actuable by play participants playing in, on or around said support structure and for allowing play participants to actively control the water flow through said one or more hollow conduits and to said one or more water forming devices, each of said play-participant-operated control devices being adapted for either instantaneous on/off or sustained on/off operation whereby each play-participant-operated control device automatically shuts off water flow to said water forming devices flowing actuation by a play participant such that overall water usage is thereby conserved.

16. The play structure of claim 15, wherein said load-bearing support structure comprises a plurality of hollow support members and said non-load-bearing hollow conduits comprise water supply tubes disposed inside one or more of said hollow support members, said water supply tubes having an external diameter that is less than the internal diameter of said hollow support members.

17. The play structure of claim 15, wherein at least one of said water forming devices comprises a watergun, bar jets, hose jets, horizontal water jets, overhead rope-pull jet, water fall, jet geyser or mist jet.

18. The play structure of claim 15, wherein at least one of said play-participant-operated control devices comprises a water control valve having an internal valve portion and an external actuator portion and wherein the actuator portion is mounted so as to be accessible to play participants playing in, on or around said support structure for controlling the water flow through said one or more hollow conduits and to said one or more water forming devices.

19. The play structure of claim 15, wherein at least one of said play-participant-operated control devices comprises a push-button actuated valve.

20. The play structure of claim 15, wherein said load-bearing support structure comprises a plurality of solid support members and said non-load-bearing hollow conduits comprise water supply tubes disposed on or adjacent one or more of said solid support members.

21. The water play apparatus of claim 15, further comprising one or more isolation valves for substantially hydraulically isolating a first group of water forming devices and associated play-participant-operated control devices from a second group of water forming devices and associated play-participant-operated control devices.

22. A kit for constructing a water play apparatus, said kit comprising:

a plurality of hollow support members and support platforms adapted to be fitted together to form a support structure having multiple support platforms at different locations and/or elevations for supporting one or more play participants playing in, on or around said support structure and one or more interconnecting bridge structures for bridging between at least two of said support platforms which are separated from one another;

one or more water supply conduits adapted to be installed inside one or more of said hollow support members, said supply conduits having an external diameter that is less than the internal diameter of said hollow support members;

one or more water forming devices sized and adapted to be fitted to said support structure and further adapted to be placed in fluid communication with one or more of said water supply conduits for spraying water and/or creating various desired water play effects, said one or more water forming devices being selected and/or adjusted to provide an aggregate water flow of less than about 200 gallons per minute; and one or more push-button actuated water control devices sized and adapted to be fitted to said support structure and arranged to be accessible to play participants playing in, on or around said support structure to allow play participants to control water flowing through one or more of said water supply conduits and/or to one or more of said water forming devices by depressing an associated push button, said push-button actuated water control devices being further adapted to automatically shut off water flow to said water supply conduits and/or interactive water play elements after said associated push-button is released such that overall water usage is thereby automatically conserved.

23. The kit of claim 22, wherein at least one of said water forming devices comprises a watergun, bar jets, hose jets, horizontal water jets, overhead rope-pull jet, water fall, jet geyser or mist jet.

24. The kit of claim 22, wherein said push-button actuated water control devices comprise instantaneous on/off valves for instantaneously turning on water flow to said one or more water forming devices when pushed by a play participant, and instantaneously turning off water flow when released.

25. The kit of claim 22, wherein when at least one of said push-button actuated water control devices comprises a sustained actuation valve for providing water flow to one or more of said water forming devices for a predetermined period of time after actuation and then shutting off the water flow.

26. The kit of claim 22, wherein at least one of said push-button actuated water control devices comprises an electric solenoid valve.

27. A water play apparatus, comprising:

a support structure including a plurality of hollow support members for safely supporting one or more play participants playing in, on or around said support structure;

one or more water supply tubes disposed inside one or more of said hollow support members, said supply tubes having an external diameter that is less than the internal diameter of said hollow support members;

one or more water play elements located on or around said support structure and in fluid communication with said water supply tubes for spraying water and/or creating various desired water play effects, said water play elements each having a flow output of between about 2 and 15 gallons per minute and having an aggregate flow out put of less than about 200 gallons per minute;

one or more water control devices disposed and arranged on or adjacent said support structure so as to allow play participants to selectively control water flow through said hollow tubes to one or more of said interactive water play elements, said water control devices being adapted to automatically shut off water flow to said water supply conduits and/or interactive water play elements following actuation thereof such that overall water usage is thereby automatically conserved; and one or more isolation valves for substantially hydraulically isolating a first group of water play elements and associated water control devices from a second group of water play elements and associated water control devices;

whereby play participants can adjust said one or more water control devices and observe the change in the rate or direction of water spraying from said one or more associated water play elements.

28. A water play structure, comprising:

a load-bearing support structure for safely supporting one or more play participants playing in, on or around said support structure, said support structure comprising multiple platforms or play areas each supported by at least one load-bearing support member, and one or more interconnecting bridge structures for bridging between at least two of said platforms or play areas which are separated from one another;

one or more water forming devices disposed in, on or around said support structure for spraying water and/or creating desired water effects;

one or more non-load-bearing hollow conduits disposed in, on or around said support structure for supplying water to said one or more water forming devices;

one or more isolation valves for substantially hydraulically isolating a first group of water forming devices and associated play-participant-operated control devices from a second group of water forming devices and associated play-participant-operated control devices; and one or more instantaneous oil/off or sustained on/off play-participant-operated control devices disposed on or adjacent said support structure for allowing play participants to control the water flow through said one or more hollow conduits and to said one or more water forming devices while automatically preventing wastage of water when play participants are not present on the play structure.

* * * * *